United States Patent [19]

Newson

[11] 4,035,956

[45] July 19, 1977

[54] DRIVING AND LOCKING MECHANISMS

[75] Inventor: John Chase Newson, London, England

[73] Assignee: Westinghouse Brake & Signal Co. Ltd., England

[21] Appl. No.: 607,592

[22] Filed: Aug. 25, 1975

[51] Int. Cl.[2] ..... E05F 15/00

[52] U.S. Cl. ..... 49/280; 49/26; 49/360

[58] Field of Search ..... 49/280, 26, 360, 363, 49/293, 298; 403/113; 91/41, 43, 44

[56] References Cited

U.S. PATENT DOCUMENTS

| | | | |
|---|---|---|---|
| 3,352,061 | 11/1967 | Chan et al. | 49/26 X |
| 3,802,125 | 4/1974 | Baker | 49/360 |

*Primary Examiner*—Kenneth Downey

*Attorney, Agent, or Firm*—Larson, Taylor and Hinds

[57] ABSTRACT

A driving and locking mechanism which employs pivoted links for coupling and transmitting motion between driving and driven members. During motion, the links are constrained to a particular mutual position for transmission of driving forces, but at one end of the range of movement, the constraint is removed and the links pivot so that one link comes into normal or over-normal contact with an abutment and so locks the driven member in position. Forces on the driven member will not move it (except in the case where the abutment is resilient to allow limited movement of the driven member in the "locked" position) and movement of the driven member can only be accomplished by movement of the driving member. Thus a separate locking or latching mechanism is not required. The mechanism is particularly applicable to sliding doors, such as those of railway vehicles, where the door needs to be locked or latched in the closed position against forces applied to the door to tend to open it.

7 Claims, 4 Drawing Figures

DRIVING AND LOCKING MECHANISMS

This invention relates to driving and locking mechanisms and relates especially but not exclusively to such mechanisms for use with sliding doors for rail vehicles.

In the field of railway vehicle doors which open and close by sliding sideways along or within the vehicle body, it is desirable (and sometimes required by official regulations) that the door operating mechanism will, when the door is closed, maintain the door held in the closed position even in the event of a failure of the door mechanism controls or power supply. In prior art arrangements utilising long stroke linear actuators (such as a piston and long cylinder supplied with pressurised air or hydraulic oil), a latch has been employed for locking the door in the closed position. Such a latch requires separate unlatching actuation to permit the door to open, and moreover is an extra mechanism which adds to the problems of cost, maintenance, reliability and safety. The present invention provides a simple and reliable mechanism which, as applied to a sliding door, obviates the need for a separate latching mechanism by being self-latching in the door-closed position. An optional extra may additionally provide for limited opening of the door with the mechanism in the door-closed position so as to allow for freeing of anything trapped by closure of the door. (The mechanism of the present invention can also be utilised for other purposes which may be unrelated to railway vehicle doors.).

According to the present invention there is provided a driving and locking mechanism including two mutually pivoted links coupling driving and driven members, said links being constrained to remain in a predetermined relative position or positions over a range of movement of the driving and driven members, and wherein at a point beyond said range the constraint is removed whereby to allow pivotal movement of the links away from said predetermined relative position or positions so that the link adjacent the driven member swings into a vertical or over-vertical position in relation to an abutment thereby to oppose movement of the driving means by forces from the driven means.

The abutment may be a resiliently movable abutment permitting a predetermined deflection of the drive means via the linkage by movement of the driven means.

Preferably the pivot of the mutually pivoted links is constrained to move over said range of movement by means of a guide track.

The drive means may comprise a sliding door actuator and the driven means may comprise a sliding door hanger.

Figure 3:
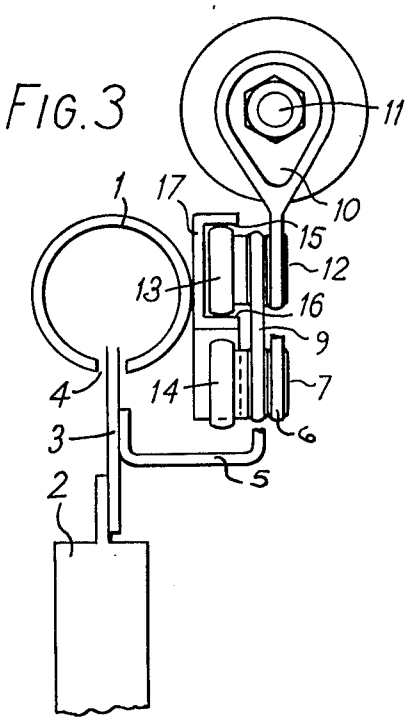
Figure 1:
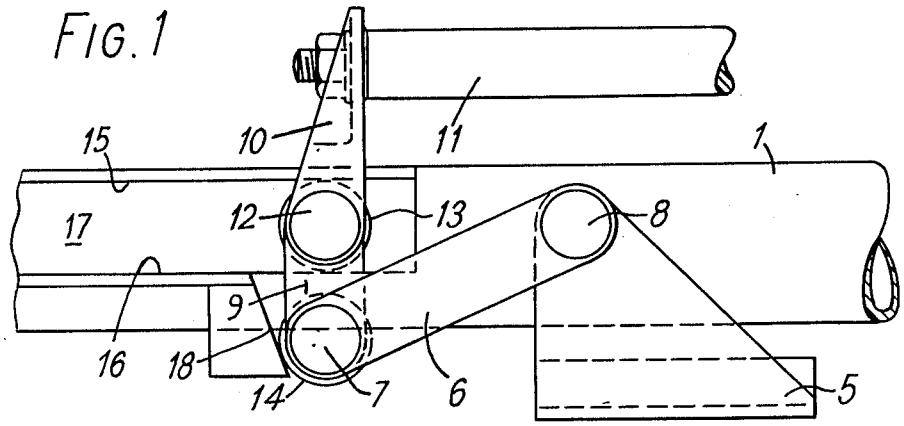
Figure 2:
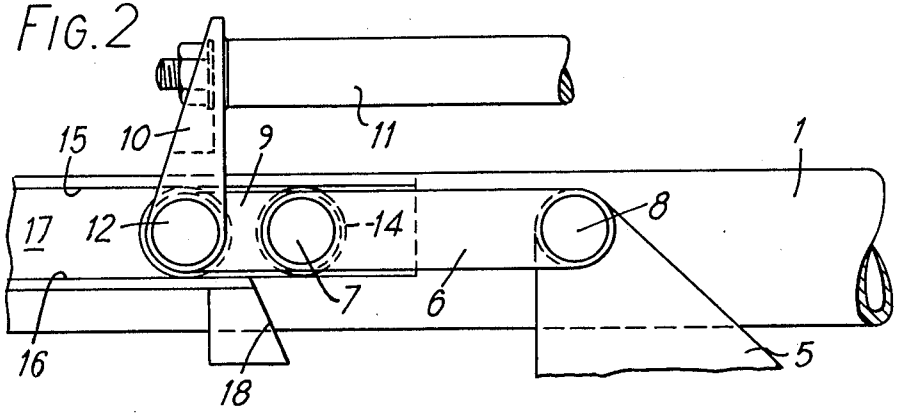
Figure 4:
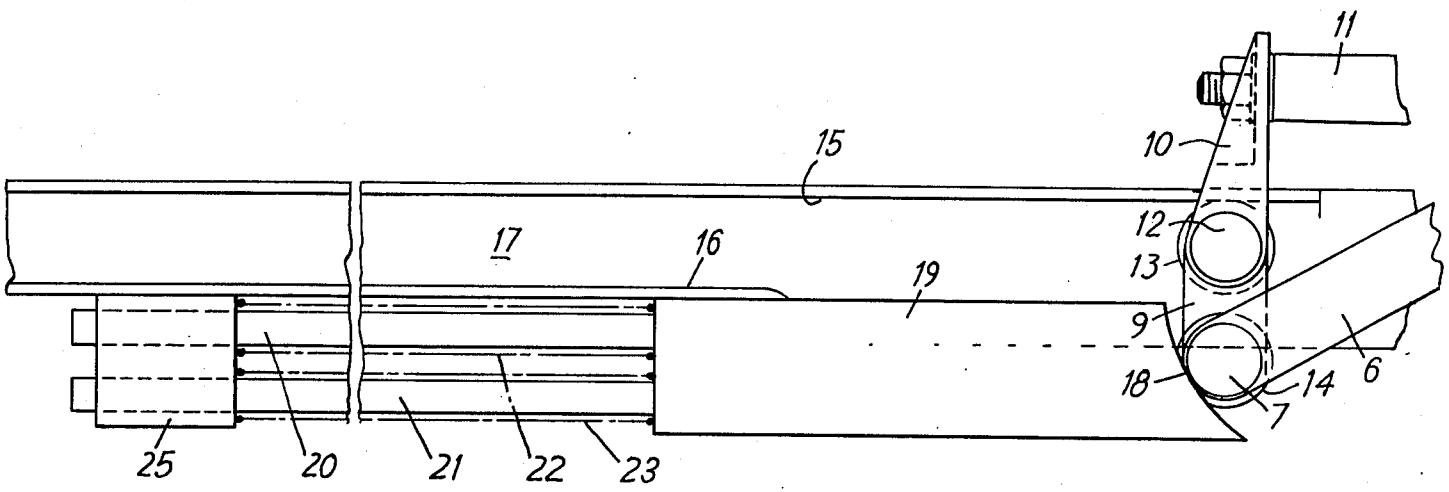

In order that the invention may be more clearly understood and readily carried into effect, the same will be further described by way of example with reference to the accompanying drawings of which, FIG. 1 illustrates a driving and locking mechanism in accordance with one embodiment of the invention, FIG. 2 illustrates the driving and locking mechanism of FIG. 1 in an alternative condition, FIG. 3 illustrates an end view of the mechanism of FIG. 1 or FIG. 2, and FIG. 4 illustrates an alternative form of locking mechanism with a resilient abutment.

Referring to the drawing and considering first FIG. 1, this shows a sliding door track in a form of a tubular member 1. The circular form of the member 1 is shown more clearly in FIG. 3 from which it is seen that a sliding door 2 is suspended via a hanger 3 extending through a slot 4 into the member 1 which carries internal rollers to which the hanger 3 is connected. Attached to the hanger 3 is a bracket 5 which has a triangular flange, the apex of which is pivotally connected at 8 to a link 6. The other end of the link 6 is pivotally connected at a pivot 7 to one end of a further shorter link 9. The other end of the link 9 is pivotally connected to a drive member 10 which is also connected to a guided rod 11 of a door actuator (not shown). The pivot 7 between the two links 6 and 9, and the pivot 12 between the link 9 and the drive member, are provided with respective rollers 13 and 14 each of which is rollingly engageable between the upper and lower surfaces 15 and 16 respectively of a guide track 17. It will be seen moreover that the lower surface 16 of the guide track 17 terminates at a point displaced from the right-hand end of the track 17 by a certain distance and is provided with a downwardly extending abutment denoted by reference 18 against which the roller 14 abuts when the apparatus is in the position shown in FIG. 1. The abutment 18 moreover is such that in the position shown in FIG. 1, which in the present instance is the closed position of the door 2, the link 6 is over-vertical or at least vertical with respect to the abutment surface 18 such that any effort exerted via the bracket 5 on the mechanism is reacted by the abutment 18 and therefore no motion is possible as a result of such a force. Thus, once the door 2 is placed in the closed position by the driving mechanism, the driving mechanism automatically locks the door 2 in the closed position so that the door 2 cannot be forced open by a passenger in the vehicle which carries the door 2. Moreover the door 2 will remain locked in the closed position even in the event of failure of the controls or power supply of the driving mechanism.

Considering now the operation of the apparatus, the position of the apparatus as shown in FIG. 1 is, as aforesaid, the door-closed position, and by reason of the vertical or over-vertical position of the link 6 in relation to the surface of the abutment 18, the mechanism is thereby locked. However, upon energisation of the actuator rod 11 tending to move the rod 11 towards the left, to tend to move the mechanism away from the door-closed position, the roller 13 is guided between the upper and lower surfaces 15 and 16 of the guide track 17 and the pivot 7 with its roller 14 is lifted upwards towards the previously remote surface 15 of the guide track 17 until a point is reached in which the roller 14 comes into contact with the surface 15, whereupon the leftward motion of the drive member 10 is transmitted directly through the two links 6 and 9 and the bracket 5 to the door hanger 3. In this state of affairs, the motion of the links 6 and 9 is constrained by the location of the rollers 13 and 14 within the surfaces 15 and 16 of the guide track 17. Under these conditions, the door actuator can actuate the movement of the door 2 in a forward or a reverse direction towards or away from the closed position, the links 6 and 9 being relatively positioned with regards to one another as shown in FIG. 2. However, on return to a state of affairs where the roller 14 passes the end of the lower surface 16 of the guide track 17, the pivot 7 and its roller 14 move downward and the roller 14 again engages the abutment 18 to re-establish the door-locking condition of the mechanism.

Referring to FIG. 4, in certain applications of door driving and locking mechanisms, it is required to permit a certain amount of movement of a closed or nearly-closed door in order to enable trapped limbs or possessions to be withdrawn. This is especially desirable in rail vehicle doors where supervision of the closing of individual doors is not provided for. In order to satisfy this requirement, the arrangement described above with reference to FIGS. 1, 2, and 3 may be modified, as shown in FIG. 4, by providing for the abutment 18 to be a resilient abutment which permits a certain degree of movement. Such a resilient abutment is provided by the sliding plunger 19 of FIG. 4, which is mounted beneath the lower surface 16 of the guide track 17 by means of a pair of horizontally slideable rods 20 and 21 carrying springs 22 and 23 respectively. The rods 20 and 21 are carried by and slideable through a suitably apertured guide block 25.

In order moveover to provide the locking mechanism with an anti-rattle capability, it may be arranged that the surface of the abutment 18 is so angled or radiused that it has a surface which at lower contact points is nearer to the pivot 8 than at upper contact points. The roller 14 thereby tends to jam against the abutment surface 18 when rolling down it. However it will be appreciated that whilst this provides an anti-rattle facility, it is inherently such that when sufficient effort is applied to the linkage 6, the roller 14 tends to roll upwards along the abutment surface 18 until a normal relationship between the link 6 and the surface 18 is returned to. The abutment surface 18 of FIG. 4 is shown curved to achieve this particular antirattle capability.

Having thus described our invention, what we claim is:

1. A driving and locking mechanism for coupling a driving member to a driven member, said mechanism comprising first and second links for coupling the driving member to the driven member so as to transmit movement therebetween; pivot means for mutually pivotally coupling said first and second links; and track means, including guide surfaces cooperating with guide surface engaging means associated with said links, for constraining said links to remain in a first, predetermined relative position over a range of movement of the driving and driven members wherein said driven member is driven by said driving member, said mechanism further comprising abutment means located adjacent a terminal end of said track means, and said terminal end of said track means providing freeing of the links from the constraint provided by said track means when said driving and driven members are at a location outside of said range of movement so as to enable a pivotal movement of said links away from said first predetermined relative position into a second substantially over-vertical locking position relative to a vertical reference wherein said abutment means engages said links at the location of said pivot means, thereby preventing movement of said mechanism from said locking position by a force other than that provided by said driving member.

2. A mechanism as claimed in claim 1, wherein said predetermined relative position is a mutually substantially collinear disposition of the links.

3. A mechanism as claimed in claim 1, wherein said guide surface engaging means are rollers pivoted on said links.

4. A mechanism as claimed in claim 1, wherein said abutment means is mounted on the mechanism by resilient mounting means to provide resilient displaceability of the abutment means to permit a predetermined limited deflection of the drive means via the links by movement-inducing forces on the driven means.

5. A mechanism as claimed in claim 1, wherein said driving means is an actuator rod, and said driven means is a sliding door movable between open and closed positions by sideways motion imparted thereto, via the links, by the actuator rod, the contacting relationship of said links and said abutment means locking said door in the closed position.

6. A mechanism as claimed in claim 4, wherein said driving means is an actuator rod, and said driven means is a sliding door movable between open and closed positions by sideways motion imparted thereto via the links, by the actuator rod, the contacting relationship of said links and said abutment means locking said door in the closed position and the resilient mounting means permitting a predeterminedly limited extent of forced opening of the door from the locked-closed position to permit the freeing of objects trapped by the closing of the door.

7. A driving and locking mechanism for a door operator for coupling the driving member of an actuator to a driven member in the form of a sliding door movable between open and closed positions, said mechanism comprising first and second links for coupling the driving member to the door so as to transmit movement therebetween; pivot means for mutually pivotally coupling said first and second links; and track means, including guide surfaces cooperating with guide surfaces associated with said links; for constraining said links to remain in a first, predetermined relative position over a range of movement of the driving and driven members wherein said door is driven by said driving member, said mechanism further comprising abutment means located adjacent a terminal end of said track means, and said terminal end of said track means providing freeing of the links from the constraint provided by said track means when said driving and driven members are at a location outside of said range of movement so as to enable a pivotal movement of said links away from said first predetermined relative position into a second, substantially oververtical locking position relative to a vertical reference wherein said abutment means engages said links at the location of said pivot means, thereby preventing movement of said mechanism from said locking position by a force other than that provided by said driving member.

* * * * *

UNITED STATES PATENT OFFICE

CERTIFICATE OF CORRECTION

PATENT NO. : 4,035,956

DATED : July 19, 1977

INVENTOR(S) : JOHN C. NEWSON

It is certified that error appears in the above-identified patent and that said Letters Patent are hereby corrected as shown below:

On the cover page, add reference to foreign priority as follows:

--[30]. Claims priority of Great Britian Patent Application Serial No. 40605/74 filed September 18, 1974.--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*